United States Patent [19]

Bertaud

[11] Patent Number: 4,721,215

[45] Date of Patent: Jan. 26, 1988

[54] EXPANDABLE RING CLOSURE DEVICE

[75] Inventor: Francois X. Bertaud, Libertyville, Ill.

[73] Assignee: Abbott Laboratories, North Chicago, Ill.

[21] Appl. No.: 901,707

[22] Filed: Aug. 28, 1986

Related U.S. Application Data

[63] Continuation of Ser. No. 816,911, Jan. 8, 1986, abandoned.

[51] Int. Cl.[4] ..... B65D 1/02

[52] U.S. Cl. ..... 215/32; 215/253

[58] Field of Search ..... 215/32, 250, 251, 252, 215/276, 253

[56] References Cited

U.S. PATENT DOCUMENTS

| | | | |
|---|---|---|---|
| 3,025,989 | 3/1962 | Williams | 215/251 |
| 3,950,917 | 4/1976 | Choksi et al. | 53/3 |
| 4,093,093 | 6/1978 | Fowles et al. | 215/251 |
| 4,111,325 | 9/1978 | Bellamy et al. | 215/232 |
| 4,176,755 | 12/1979 | Winchell | 215/32 |
| 4,371,089 | 2/1983 | Barendregt | 215/256 |
| 4,378,891 | 4/1983 | Fowles et al. | 215/32 |
| 4,402,415 | 9/1983 | Hopley | 215/32 |
| 4,402,417 | 9/1983 | Corrigan, Jr. et al. | 215/232 |
| 4,405,053 | 9/1983 | Cherot | 215/32 |
| 4,457,438 | 7/1984 | Varlet et al. | 215/252 |
| 4,467,930 | 8/1984 | Schnell et al. | 215/32 |
| 4,478,342 | 10/1984 | Slater et al. | 215/32 |
| 4,494,663 | 1/1985 | Bertaud et al. | 215/232 |

*Primary Examiner*—Donald F. Norton

*Attorney, Agent, or Firm*—Martin L. Katz; Michael J. Roth

[57] ABSTRACT

A closure device for severing the frangible section between the cap and body of a blow-fill-seal plastic container comprising an expandable ring constructed and arranged to encircle the container cap, an outer ring having at one end internal threads compatible with the external threads located on the neck of the container body and a tamper proof overcap.

Counterclockwise rotation of the outer ring transmits uniform upward pressure to the expandable ring which causes tension between the container cap and container body, rupturing the frangible line of weakness on the container, to permit opening of the container. Conversely, clockwise rotation of the outer ring causes compression to rupture the frangible line of weakness. Subsequent counterclockwise rotation opens the container. In either case the container cap is retained within the outer ring and is replaceable on the container.

8 Claims, 7 Drawing Figures

EXPANDABLE RING CLOSURE DEVICE

This is a continuation of application Ser. No. 816,911, filed Jan. 8, 1986 now abandoned.

BACKGROUND OF THE INVENTION

This invention relates to a closure device for a plastic container, and more particularly to a tamperproof closure.

Plastic containers for which this invention is intended are commonly used in the medical and health industries to store and transport liquids, drugs, pills and the like, both prescription and non-prescription. The containers are generally disposable and are made of thermoplastic material having a hermetically sealed top. The manufacture of such containers typically utilizes the blow-fill-seal technology whereby the container is molded, filled with the contents of choice, and sealed in a single operation. The blow-fill-seal method of producing such containers readily lends itself to mass production, primarily because of its simplicity in manufacture and low cost.

One of the features of blow-fill-seal containers is that during the manufacturing process, the neck of the container can be constructed to have a frangible portion between the intended body and integral cap of the container. Closure devices are then used in conjunction with the containers and are constructed so that the operation of the closure device breaks the frangible portion, and opens the container.

Closure devices of the foregoing general type have taken many forms over the years. For example, Komendowski U.S. Pat. No. 3,804,282, relates to a closure device which employs a cap which must first be threaded downwards to break the frangible portion, and then unthreaded upward in counter-clockwise rotation in order to open the container. Rivli U.S. Pat. No. 4,096,962 relates to a separate chisel-containing ring opener for opening hermetically sealed containers such that as the ring opener is threaded downward onto the container, downward pressure seats the chisels into a ridge on the container. When the ring opener is unthreaded upwardly, the chisels break the frangible portion to open the container.

The opening action of rupturing a frangible portion of a sealed container has been demonstrated in a variety of forms. For example, in Bellamy, U.S. Pat. No. 4,111,325, an outer ring is used which, when rotated downwardly, produces an upwardly jacking action on an overcap, thereby breaking the frangible section. Another example is D'Amico U.S. Pat. No. 4,434,904 wherein jacking action is produced when the outer portion is rotated and jacking ring fingers push upwardly on the top of the closure.

Yet another example is illustrated in Bertaud U.S. Pat. No. 4,494,663, wherein a screw type cap member has a tear-away portion and internal threading which engages threading on the container. Upon removal of the tear-away portion, the cap engages the container threading and the container frangible section is broken when the cap is downwardly rotated. Subsequent unthreading of the cap opens the container.

Such devices are not entirely satisfactory because they involve complex jacking action, downward rotation, frangible sections on both outer and inner caps, their manufacture is complicated, and, despite their construction, are often difficult to open.

SUMMARY OF THE INVENTION

The present invention provides inexpensive solutions to the problems and difficulties encountered with prior art closure devices by providing a closure device which is simple to manufacture and assemble. The present invention thus provides a closure device which can be assembled without stressing the container line of weakness and thus without the risk of rupturing the frangible position. Furthermore, the expandable ring closure device of the present invention will open the container with either clockwise rotation through the use of direct uniform compression or counterclockwise through uniform tension, the expandable ring acting as an intermediate jacking member. A three-part construction provides simplicity of manufacture, mechanical and environmental protection to the closure area, and a frangible overcap providing immediate visual evidence of prior opening.

The closure device of this invention includes three easily assembled parts which fit onto the body of a blow-fill-seal container having a frangible section as the top for the container. The closure device of the present invention, which houses the cap, includes a substantially circular outer ring and an expandable ring means. An overcap may also be included. The circular outer ring has a lower portion which includes internal threading compatible with the external threading on the neck of the blow-fill-seal container and an upper portion which includes an interior annular lip. The interior annular lip is shaped so that it overlaps the lower edge of the cap groove and, additionally, cradles the expandable ring. The expandable ring is formed to fit around the cap and is carried in an annular cap groove integral to the container and positioned below the top of the container. An overcap, which fits over the cap of the container, and which also includes frangible lines of weakness defining a frangible ring, is attached to the blow-fill-seal container by means such as spin-welding or the like.

In operation, the overcap is removed through the use of a pull-tab, which ruptures the frangible lines of weakness on the overcap, thereby providing for the separation of the frangible ring. Evidence of opening is thus clearly demonstrated, and the split ring closure device may then be exposed. The container can then be opened in either of two ways: first, by rotation of the circular outer ring in an upward direction relative to the body of the container so that the circular outer ring will uniformly cam the expandable ring against the cap, thereby producing sufficient tension to break the frangible seal between the cap and the container; second, by rotation of the circular outer ring downward relative to the body of the container so that the uniformly applied compression will break the frangible seal between the cap member and the container. Once the frangible seal between the cap member and the container is broken, the cap can be removed. The cap is advantageously retained within the circular outer ring by the expandable ring.

BRIEF DESCRIPTION OF THE DRAWINGS

The accompanying drawings illustrate the preferred embodiment of the invention, without limitation. In the drawings, like elements are identified by like symbols in each of the views and.

DESCRIPTION OF THE PREFERRED EMBODIMENT

Figure 1:
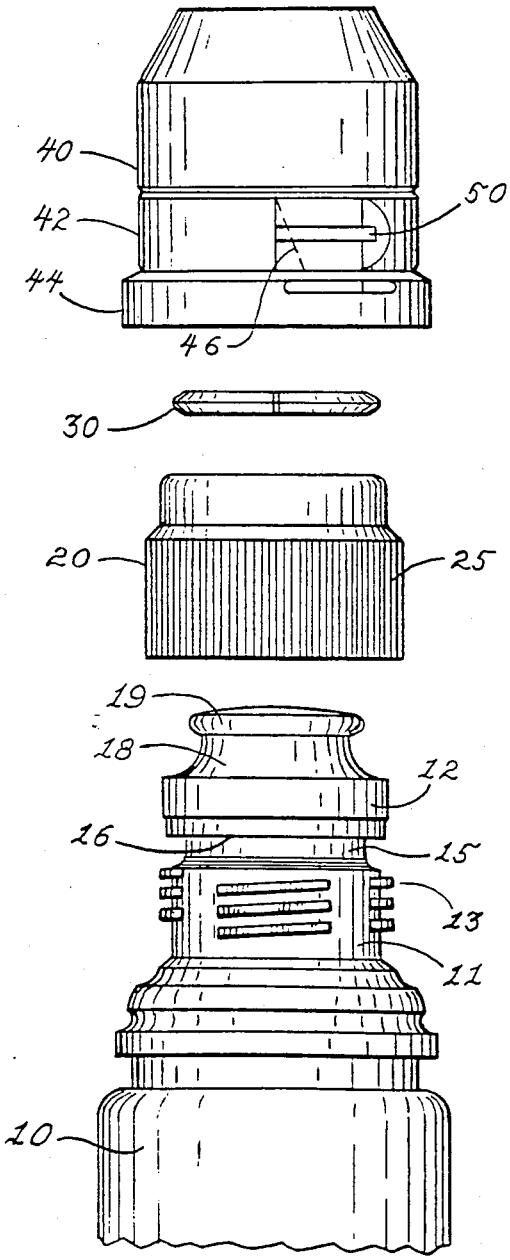
FIG. 1 is an exploded view of the closure device showing the integral elements prior to assembly.

Referring to the drawings, FIG. 1 illustrates the preferred embodiment of the invention in association with a container 10. The invention thus comprises a circular outer ring 20 and a split ring 30. The embodiment illustrated includes an overcap 40 with pull tab 50.

The container 10 is of unit construction and is preferably manufactured from plastic material utilizing the well-known blow-fill-seal technology. The container 10 narrows to form a neck 11 having interrupted bottle threading 13. Interrupted bottle threading is preferred because it reduces friction during threading. Neck 11 further reduces in diameter to form a vertical cylindrical portion 15 which is frangibly connected to the cap section 12 of the container 10 along a line of weakness 16. The cap section 12 is preferably of increased diameter in order to overfit vertical cylindrical portion 15. The upper portion of the cap section 12 forms a split ring groove 18 for carrying a split ring means and further forms the cap abutment 19, which will be described in detail hereinafter.

Figure 2:
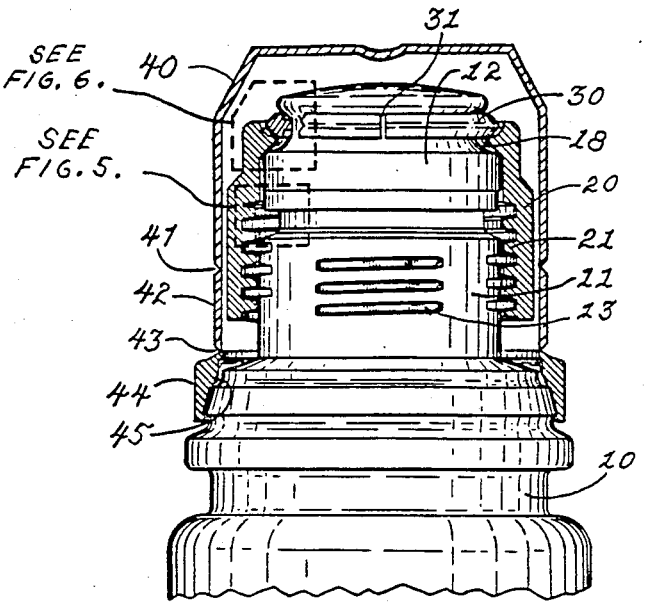
FIG. 2 is a cross-sectional side view of the overcap and outer ring and a side view of the container and split ring, showing all elements in place with the container sealed.
Figure 6:
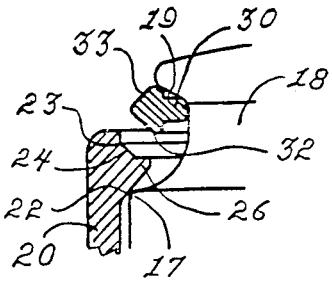
FIG. 6 is a cross-sectional view of the interface between the split ring and the outer cap.

The outer ring 20 is substantially circular and is illustrated with external knurling serrations 25, and includes, in the lower section, as illustrated in FIG. 2, internal threading 21 compatible with the interrupted bottle threading 13 on neck 11 of container 10. Referring to FIG. 6, the upper section of the outer ring 20 has an interior lip 26, which includes an upper side 24 which provides a cradle 23 for the split ring 30 and an underside 22 which rests on the lower groove edge 17 of the cap section 12 (FIG. 6).

Figure 4:
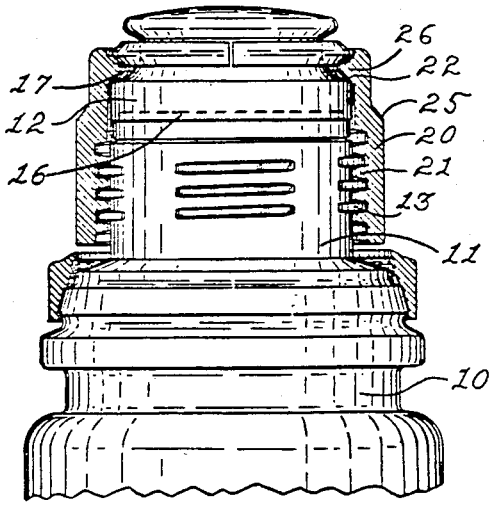
FIG. 4 is a side view of the closure device, with a cross-sectional side view of the outer ring, showing the overcap removed and the outer ring in the threaded downward position.
Figure 7:
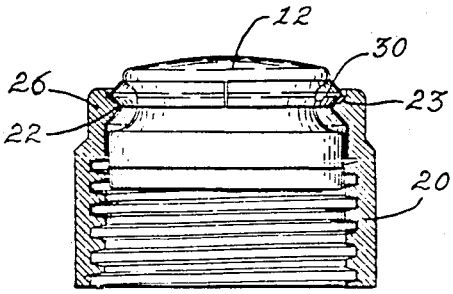
FIG. 7 is a side view of the closure device, with a cross-sectional side view of the outer ring showing the cap of the container removed and retained.

As best seen in FIGS. 4, 6 and 7, the interior lip 26 provides a means by which to transmit or impart the rotational force applied to the outer ring to the line of weakness 16, and, with sufficient force to rupture the line of weakness to open the container, as the outer ring 20 is rotated in either direction. For example, the upper side 24 of interior lip 26 serves as a means to transmit or impart the rotational force to the split ring 30 as the outer ring 20 is rotated in order to open the container. By way of illustration, the upward force produced by the counterclockwise rotation of the outer ring 20 is carried by the lip 26 which cams, preferably uniformly, the split ring 30 upwardly against the cap abutment 19 to produce the tension necessary to rupture the frangible line of weakness 16. Alternatively, the underside 22 of lip 26 may likewise serve as a means to transmit or impart the rotational force to the lower groove edge 17 of the cap as the outer ring is rotated in order to open the container. By way of illustration, downward force produced by the clockwise rotation of the outer ring 20 is transmitted, preferably uniformly, from the underside 22 of interior lip 26 to the lower groove edge 17 of the cap thereby producing the compression necessary to rupture the frangible line of weakness 16.

The first opening mode is generally preferred because it utilizes familiar cap removal motions thereby eliminating training requirements. Moreover, it is typically faster, which is valuable for hospital emergency room use and the like. Further, the split ring material is preferably selected for reduced friction properties, which likewise contributes to the ease with which the bottle may be opened.

Referring to FIG. 2, as illustrated, the split ring 30 is formed of resilient material, is substantially circular in shape and includes a separation 31 to permit the split ring 30 to seat over the cap abutment 19, and thus to be fitted into the split ring groove 18. Cap abutment 19 thus provides a means to retain the ring in the split ring groove 18 after assembly. The split ring 30 preferably has a symmetrical cross section, to eliminate any need to orient the split ring during assembly. As shown in more detail in FIG. 6, the split ring 30 has an V-shaped lower section 32 which presents a cooperating ramp to the upper side of lip 26 of the outer ring 20. The split ring 30 further includes an inverted V-shaped upper section 33, the interior side of which fits snugly against the cap abutment 19. Thus, when an upward force is exerted on the split ring 30 from the outer ring 20, the split ring 30 provides uniform contact with and force transmittance to cap abutment 19.

Referring to FIGS. 1 and 2, the overcap 40 is substantially cup-shaped and serves as tamperproof protection and as an environmental barrier to prevent contamination of the entire closure area until the time of first use. Included in the structure of the overcap 40 are three (3) frangible lines of weakness 41, 43, 46, and a frangible ring section 42 lies therein between. A pull tab 50 is carried by said frangible ring section so that when it is activated, the frangible lines of weakness 46, 41, and 43 are ruptured, and the frangible ring section 42 is separated carrying with it overcap 40. The lower edge 44 of the overcap 40 is sealed 45 to the container body 10 and remains attached thereto. Seal 45 is achieved by bonding or welding means such as heat seal, ultrasonic or spin welding techniques or the like.

Simplicity of manufacture is clearly shown, with the pre-formed plastic container body 10 threadedly receiving the outer ring 20, followed by placement of the split ring 30 into the split ring groove 18 on the cap section 12, and attachment of the overcap 40 to the container body 10 in one continuous process.

In operation, manually applied tension to the pull tab 50 removes the overcap 40 as indicated above, leaving the top of the container 10 and split ring closure device exposed.

Figure 3:
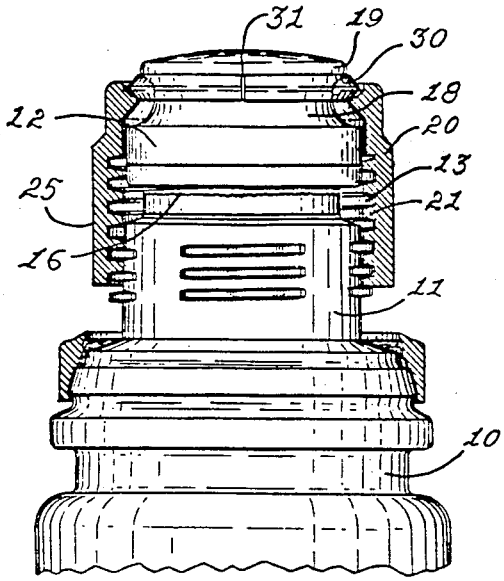
FIG. 3 is a side view of the closure device, with a cross-sectional side view of the outer ring, showing the overcap removed and the outer ring in the threaded upward position.
Figure 5:
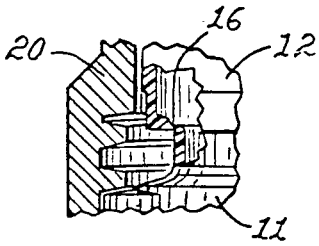
FIG. 5 is a cross-sectional view of the frangible portion between the cap section and body of the container.

The container 10 is then capable of being opened in either of two ways. The first method for opening the container 10, as shown in FIG. 3, requires application of counter-clockwise torque, the normal loosening motion, to the outer ring 20, whereby the compatible interior threading 21 of the outer ring 20 and the exterior threading 13 on the container neck 11, produces an upward force on the outer ring 20. This upward force is transmitted to the split ring 30 by means of the lip 26 of the outer ring 20. This force constricts the separation 31 in split ring 30 so as to tighten split ring 30 around the split ring groove 18 on cap section 12 and forces the split ring 30 uniformly upwardly against cap abutment 19. This transmitted upward force produces tension between cap section 12 and neck 11 which is sufficient to completely rupture the frangible line of weakness 16 between cap section 12 and neck 11 as illustrated in more detail in FIG. 5. Continued counter-clockwise torque applied to outer ring 20 will open the container. Cap section 12 is retained, as shown in FIG. 7, within outer ring 20 by the cooperation of split ring 30, cap abutment 19 and the underside edge 22 of interior lip 26. Upward movement of the cap section 12 relative to the outer ring 20 is limited by the underside edge 22 of the interior lip 26 of the outer cap, and downward movement of the cap section 12 relative to the outer ring is limited by the split ring 30, seated in the cradle 23 of the outer ring 20, which is adapted to abut cap abutment 19.

The second method for opening the container, as illustrated in FIG. 4, requires application of clockwise torque, the normal tightening motion, to outer ring 20. Clockwise torque causes transmittance of the rotational force to the compatible interior threading 21 of outer ring 20 and exterior threading 13 on the container neck 11, which thereby produces a downward force on outer ring 20. This downward force is uniformly transmitted by the underside edge 22 of the interior lip 26 of outer ring 20 to the lower groove edge 17 of cap section 12. The transmitted uniform downward force compresses cap section 12 and neck 11, and is sufficient to completely rupture the frangible line of weakness 16 between cap section 12 and neck 11. Outer ring 20 can then be rotated counter-clockwise, the normal loosening motion, to remove cap section 12 from neck 11 and thereby open the container. Cap section 12 will be retained in the outer ring as indicated above.

Although the hermetic seal is thus broken, the container can be closed by normal cap replacement rotation.

I claim as my invention:

1. A closure device for use with a blow-fill-seal container, said container having an integral cap and body portion, said cap including a top, a cap abutment at said top, and a cap groove below said cap abutment, said body portion including a threaded neck and being connected to said cap by a frangible line of weakness between said cap and said neck, said closure device comprising in combination, a substantially circular outer ring means, and a separate substantially circular expandable ring means, said outer ring means including a lower portion and an upper portion, said lower portion having internal threads compatible with said neck thread, said upper portion forming a force transmittance means bearing on said expandable ring means, and said expandable ring means being adapted to be captively carried in said cap groove in between said force transmittance means and said cap abutment so that rotation of said outer ring means in either direction transmits force through said force transmittance means to rupture said frangible line of weakness thereby permitting opening of said container.

2. A closure device as claimed in claim 1 wherein said force transmittance means forms an interior lip having an upper portion for carrying said expandable ring means so that counterclockwise rotation applied to said outer ring means produces an upward force which is imparted by said force transmittance means to said expandable ring means, said expandable ring means thereby being cammed against said cap groove so as to transfer said upward force to said cap abutment thereby transferring sufficient force to said frangible line of weakness to rupture it.

3. A closure device as claimed in claim 2 wherein said outer ring means and said expandable ring means are adapted to retain said container cap in said outer ring means after removal of said container cap from said container body.

4. A closure device as claimed in claim 2 wherein said expandable ring means is carried in said upper portion of said interior lip and is adapted to abut said cap abutment of said cap, and said interior lip forms an underside portion adapted to abut said cap so that upward movement of said cap relative to said outer ring is limited by the abutment of said underside portion of said interior lip against said cap and downward movement of said cap relative to said outer ring is limited by abutment of said expandable ring means against said cap abutment whereby said cap is retained in said outer ring.

5. A closure device as claimed in claim 4 wherein said expandable ring means comprises a split ring which includes a separation to permit said split ring to be expanded over said cap abutment and seat in said cap groove.

6. A closure device as claimed in claim 5 wherein said split ring has an upper portion which is inverted V-shaped.

7. A closure device as claimed in claim 5 wherein said split ring has a lower portion which is V-shaped.

8. A closure device as claimed in claim 1 wherein said force transmittance means is adapted to bear on said container cap so that clockwise rotation applied to said outer ring means produces a downward force which is imparted by said force transmittance means to said container cap thereby transmitting sufficient force to said frangible line of weakness to rupture it.

* * * * *